US006260378B1

(12) United States Patent
Sagar

(10) Patent No.: US 6,260,378 B1
(45) Date of Patent: Jul. 17, 2001

(54) REFRIGERANT PURGE SYSTEM

(75) Inventor: Christopher L. Sagar, Sarasota, FL (US)

(73) Assignee: Reftec International, Inc., Clearwater, FL (US)

( * ) Notice: Subject to any disclaimer, the term of this patent is extended or adjusted under 35 U.S.C. 154(b) by 0 days.

(21) Appl. No.: 09/438,329

(22) Filed: Nov. 13, 1999

(51) Int. Cl.[7] ..... F25B 43/04
(52) U.S. Cl. ..... 62/475; 62/149
(58) Field of Search ..... 62/475, 149

(56) References Cited

U.S. PATENT DOCUMENTS 5,398,518 * 3/1995 Veer ..... 62/195
5,517,825 * 5/1996 Manz et al. ..... 62/158
5,582,019 * 12/1996 Hanna et al. ..... 62/85
5,582,023 * 12/1996 O'Neal ..... 62/195
5,592,826 * 1/1997 Sagar et al. ..... 62/195
5,598,714 * 2/1997 Strout et al. ..... 62/85
5,636,526 * 6/1997 Plzak et al. ..... 62/475
5,664,424 * 9/1997 Olds ..... 62/85
5,806,322 * 9/1998 Cakmakei et al. ..... 62/85
5,921,097 * 7/1999 Galbreath, Sr. ..... 62/195
6,128,916 * 10/2000 Callahan et al. ..... 62/475

* cited by examiner

*Primary Examiner*—William Doerrler
*Assistant Examiner*—Mark Shulman
(74) *Attorney, Agent, or Firm*—A. W. Fisher, III

(57) ABSTRACT

A refrigerant purge system for use with a chiller including a condenser and evaporator to remove noncondensables from the refrigerant comprising a refrigerant separation stage to separate noncondensables from the refrigerant coupled to the chiller by a refrigerant/noncondensables input stage to receive refrigerant and noncondensables from the chiller when noncondensables therein reach a predetermined level and a refrigerant output stage to feed condensed refrigerant to the chiller when condensed refrigerant within the refrigerant separation stage reaches a predetermined level and a noncondensable output stage to release noncondensables to the atmosphere when the noncondensables within the refrigerant separation stage reach a predetermined level.

19 Claims, 1 Drawing Sheet

REFRIGERANT PURGE SYSTEM

BACKGROUND OF THE INVENTION

1. Field of the Invention

A refrigerant purge system to remove noncondensables from a refrigerant circulating through an air conditioning system.

2. Description of the Prior Art

In the air conditioning systems, a refrigerant is alternately expanded into a gaseous state and condensed into a liquid state; heat is absorbed and released, respectively, as a result of such expansion and contraction. When the refrigerant is pure and unadulterated by contaminates such as air and moisture, condensation is complete and the system operates at maximum efficiency; contaminants enter the refrigerant, however, the condensation equipment is unable to condense all such contaminants and the efficiency of the system drops accordingly. In the industry contaminants that cannot be condensed are known as "noncondensables."

Noncondensables enter most air conditioning systems these systems operate under vacuum. Thus those of ordinary skill in the art have attempted to build leak-proof systems, but a truly leak-proof system would be cost prohibitive. Most inventors, however, have accepted the fact of leakage and have developed systems designed to purge noncondensables from the system.

U.S. Pat. No. 5,031,410 shows a refrigeration system thermal purge apparatus that adds a discrete purge refrigerant circuit to the conventional condenser which is exposed to still lower temperatures of an auxiliary condenser.

When the temperature within the auxiliary condenser drops to 18 degrees F., as detected by a thermostat, the contents of said auxiliary condenser are purged to the atmosphere. Although, at 18 degrees F., some separation of condensables and noncondensables will have been achieved, complete separation will not have been achieved; thus, some condensables such as CFC's and HCFC's will be purged into the atmosphere.

U.S. Pat. No. 4,169,356 describes a secondary refrigeration system used to chill the thermal purge apparatus that also utilizes a discrete purge refrigerant circuit to the conventional condenser which is exposed to the still lower temperatures of an auxiliary condenser, but does so without increasing the pressure in the purge vessel and relying solely on thermal migration or pressure differential to motivate the noncondensables into the purge vessel.

U.S. Pat. No. 5,592,826 relates to an air conditioning system comprising a self-regulating flow controller having no moving parts that provides a liquid seal between a purge vessel and the evaporator barrel of a chiller. Circulating refrigerant fluid from a primary air conditioner is preheated in a preheater by hot refrigerant from the chiller prior to its entry into the purge vessel, and the preheater provides a thermal load that enables operation of the purge vessel. The purge unit discharges into a regeneration cell that removes even more refrigerant from the vapors before they are vented to atmosphere. When the regeneration cell requires recharging, it is heated to a predetermined temperature and pressure to release absorbed refrigerant from its absorption media, and the released refrigerant is routed back to the purge vessel and hence through the regeneration cell again prior to discharge of substantially refrigerant-free contaminants into the atmosphere.

U.S. Pat. No. 5,309,729 discloses a thermal purge system includes a purge vessel into which is introduced hot gaseous refrigerant fluid from the outlet of a conventional chiller. A first coil having very cold refrigerant fluid flowing through it is positioned within the vessel so that much of the hot gaseous refrigerant fluid from the chiller is condensed upon contact with the coil. The condensate collects on the bottom of the vessel until it reaches a depth sufficient to initiate a siphoning action by an artesian well, which returns the condensate to the chiller. Uncondensed gases are reheated and re-expanded external to the vessel and returned to the vessel through a second coil in heat transfer relation to the first coil so that further condensation occurs. Noncondensables which remain after the reheating, reexpansion, and recooling are purged to the atmosphere.

None of the prior arts utilize a microprocessor of the purge unit to maximize separation and provide a high level of separation and efficiency nor do the prior arts utilize an external pressure and temperature device along with microprocessor to determine when the purge should run for maximum energy saving and increase operating efficiency and longevity.

Thus, there is a need to provide a purge apparatus that provides a complete separation of condensables and noncondensables before the noncondensables are purged to the atmosphere and to do this via its own on-board, oil-less compressor and via a suitable micro controller.

Moreover, the thermal purge units heretofore known are inefficient to the extent that they do not hold the condensable/noncondensables mixture at a constant low temperature for extended periods of time nor do they raise the pressure high enough in the purge vessel to properly separate out the noncondensables. Thus, insufficient time is available for the condensable and noncondensables to separate. The known systems also do not operate well under high load conditions, i.e., they are inefficient at high temperature gradients because they lack properly sized cooling means and regulate the secondary coiling system with a fixed non variable constant pressure regulator that does not adjust for varying loading conditions. Units currently on the market today rely on thermal migration or a small differential pressure to receive the noncondensables from the system for these reasons.

There is a need, therefore, for a system that does more than merely provide an auxiliary condensation system that does not produce a complete separation of condensables and noncondensables.

When the prior art was considered as a whole, at the time the present invention was made, it neither taught nor suggested to those of ordinary skill in this field how an improved system could be built.

SUMMARY OF THE INVENTION

The present invention relates to a refrigerant purge system to purge noncondensable gases present in a chiller including a chiller condenser, a chiller compressor and a chiller evaporator operatively coupled together to function as a conventional chiller for an air conditioning system.

The refrigerant purge system comprises of a refrigerant separation stage to separate noncondensables from the refrigerant coupled to the chiller by a refrigerant/noncondensables input stage to receive refrigerant and noncondensables therefrom when the noncondensables therein reach a predetermined level and to the chiller by a refrigerant output stage to feed condensed refrigerant thereto when condensed refrigerant within the refrigerant separation stage reaches a predetermined level, a noncondensables output stage coupled to the refrigerant separation stage that releases noncondensables to the atmosphere when noncondensables within the refrigerant separation stage reach a predetermined level and a purge control means operatively coupled to the chiller, the refrigerant separation stage, the refrigerant/noncondensables input stage, the refrigerant output stage and the noncondensable output stage to control operation of the refrigerant purge system.

The refrigerant separation stage comprises a purge separation vessel to receive refrigerant and noncondensables from the refrigerant/noncondensables input stage and a secondary refrigeration system to condense gaseous refrigerant entering the interior of the purge separation vessel. The secondary refrigeration system comprises an evaporator coil coupled to an air cooled condenser and to a compressor. The secondary refrigeration system further includes a flow control to control the flow of liquid refrigerant therethrough.

The refrigerant/noncondensables input stage comprises a refrigerant/noncondensables conduit operatively coupled between the chiller and the refrigerant separation stage to selectively feed refrigerant and noncondensables thereto.

The refrigerant output stage comprises a refrigerant conduit operatively coupled between the interior of the purge separation vessel and the chiller to selected feed refrigerant thereto.

The noncondensable output stage comprises a noncondensable conduit extending from the upper portion of the purge separation vessel to the atmosphere.

The purge control means comprises a microprocessor operatively to a refrigerant/noncondensable flow control section, a refrigerant flow control section and a noncondensable flow control section by a plurality of conductors or control lines to selectively control the flow of refrigerant/noncondensable, refrigerant and noncondensable respectively through the refrigerant/noncondensables input stage, the refrigerant output stage and the noncondensable output stage respectively. Each control section comprises a monitoring section to monitor preselected stage operating parameters and a flow section to selectively control the flow of fluid therethrough.

Specifically, the monitoring device of the refrigerant/noncondensable flow control section comprises a pressure sensor and a temperature sensor disposed to monitor or sense the pressure and temperature within the chiller; while, the flow control section of the refrigerant/noncondensable flow control section comprises a normally closed isolation valve disposed to selectively control the flow of the refrigerant and noncondensable from the chiller to the refrigerant separation stage. The monitoring section of the refrigerant flow control section comprises a liquid level sensor disposed in the lower portion of the purge separation vessel disposed to monitor or sense the level of liquid refrigerant in the purge separation vessel; while, the flow control section of the refrigerant flow control section comprises a normally closed solenoid valve disposed to selectively control the flow of refrigerant from the purge separation vessel to the chiller. The monitoring device of the noncondensables flow control section comprises a pressure sensor and a temperature sensor disposed to monitor or sense the pressure and temperature with the purge separation vessel; while, the flow control device of the noncondensable flow control section comprises a normally closed solenoid valve disposed to selectively control the flow of noncondensables from the purge separation vessel to the atmosphere.

In operation, the chiller refrigerant is monitored by the pressure sensor and temperature sensor. The microprocessor memory has an array of pressures and temperatures relating to the specific refrigerant that is being used with the chiller. The pressure and temperature information received from the chiller by microprocessor is compared to the established pressure and temperature of the specific refrigerant in use. When the refrigerant pressure within the chiller is greater than the established corresponding refrigerant temperature, the refrigerant purge system is actuated. Once the refrigerant purge system is actuated or activated, gaseous refrigerant containing moisture and noncondensables enters the refrigerant purge system. The gas passes through the isolation valve into the purge separation vessel.

The interior of the purge separation vessel is maintained at about twenty-five to about thirty-five degrees F. by the liquid refrigerant that flows through the evaporator coil. The secondary refrigeration system maintains this low temperature in the purge separation vessel regardless of loading conditions from hot gas and noncondensables. Liquid refrigerant is metered into the purge separation vessel and regulated by the external thermal sensing bulb. This liquid refrigerant absorbs the heat from higher temperature gases injected into purge separation vessel. This process continues as long as the refrigerant purge system is operating. Because of this highly efficient external cooling means, all of the hot compressed gaseous fluids flowing from the purge inlet conduit condenses upon contact with evaporator coil. Condensed refrigerant collects on the bottom of purge separation vessel. Once the condensed refrigerant, containing virtually no noncondensables, reaches a predetermined level as sensed by the liquid level sensor, a switch is activated. This allows the condensed liquid refrigerant to return to the chiller. This operation does not affect the performance of the refrigerant purge system.

The refrigerant condenses into liquid refrigerant and separates from the other gases and noncondensables present in the purge separation vessel. The highly compressed gaseous vapor and noncondensables remaining within purge separation vessel will separate through various partial pressures and temperature based on the specific gas laws of the refrigerant being separated from noncondensables. The temperature and pressure of this mixture is monitored by the temperature sensor and the pressure transducer. These values are used in an internal array of various empirical and ordinary differential equations and formulas programmed into the microprocessor that are used to calculate the amount of noncondensables present in the purge separation vessel. At a predetermined level, the noncondensables gases will be released into the atmosphere.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PRESENT INVENTION

Figure 1:
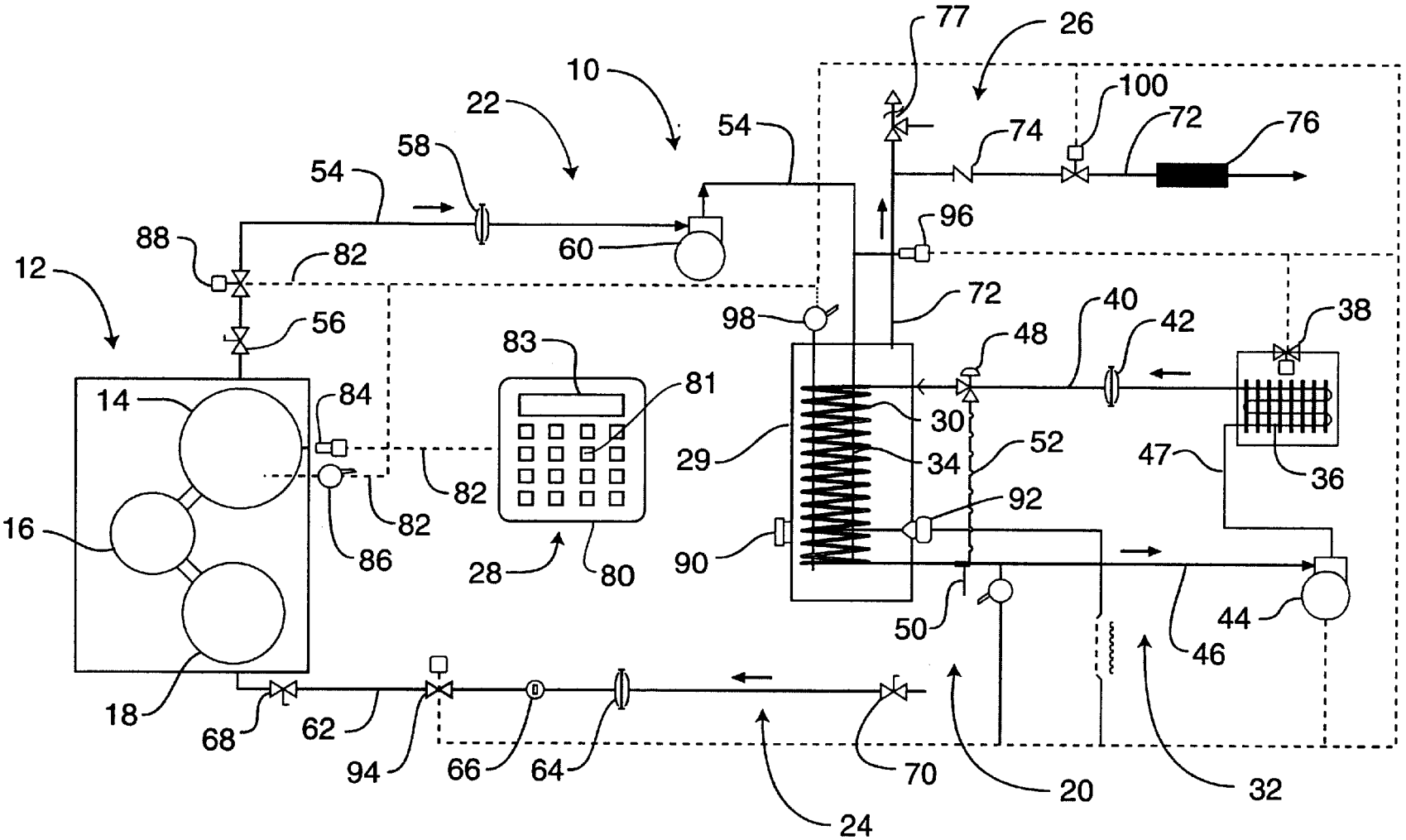
FIG. 1 is a schematic of the refrigerant purge system of the present invention operatively coupled to a chiller.

As shown in FIG. 1, the instant invention relates to a refrigerant purge system generally indicated as 10 to purge noncondensable gases present in a chiller generally indicated as 12 which condenses refrigerant for circulation in a air conditioning system. The refrigerant purge system 10 receives only those gases that are not condensed by the chiller 12. These gases contain condensables that have not been condensed by the chiller 12 as well as noncondensable gases to be purged into the atmosphere.

The chiller 12 comprises a chiller condenser 14, a chiller compressor 16 and a chiller evaporator 18 operatively coupled together to function as a conventional chiller for an air conditioning system.

The refrigerant purge system 10 comprises a refrigerant separation stage generally indicated as 20 to separate noncondensables from the refrigerant coupled to the chiller condenser 14 of the chiller 12 by a refrigerant/noncondensables input stage generally indicated as 22 to receive refrigerant and noncondensables from the chiller 12 when the noncondensables within the chiller 12 reach a predetermined level and to the chiller evaporator 18 of the chiller 12 by a refrigerant output stage generally indicated as 24 to feed condensed refrigerant to the chiller 12 when condensed refrigerant within the refrigerant separation stage 20 reaches a predetermined level, a noncondensables output stage generally indicated as 26 coupled to the refrigerant separation stage 20 to release noncondensables to the atmosphere when noncondensables within the refrigerant separation stage 20 reach a predetermined level and a purge control means generally indicated as 28 operatively coupled to the chiller 12, the refrigerant separation stage 20, the refrigerant/noncondensables input stage 22, the refrigerant output stage 24 and the noncondensable output stage 26 to control operation of the refrigerant purge system 10.

The refrigerant separation stage 20 comprises a purge separation vessel 29 to receive refrigerant and noncondensables from the refrigerant/noncondensables input stage 22 through an purge inlet conduit 30 and a secondary refrigeration system generally indicated as 32 to condense gaseous refrigerant entering the interior of the purge separation vessel 29 through the purge inlet conduit 30. The secondary refrigeration system 32 comprises an evaporator coil 34 disposed with the purge separation vessel 29 in heat transfer relationship relative to the purge inlet conduit 30 coupled to an air cooled condenser 36 and a fan 38 by a liquid refrigerant conduit 40 having an inlet filter 42 and coupled to a compressor 44 by a vapor conduit 46. The compressor 44 is operatively coupled to the air cooled condenser 36 by a compressor/condenser conduit 47. The secondary refrigeration system 32 further includes a flow control comprising an expansion valve 48 operatively disposed in the liquid refrigerant conduit 40 coupled to a thermal sensing bulb 50 disposed in a temperature sensing relationship relative to the vapor conduit 46 coupled to the expansion valve 48 by a conductor or control line 52 to control the flow of liquid refrigerant therethrough to maintain the temperature in the purge separation vessel 29 with a predetermined range of between about 25 degrees F. to about 35 degrees F. Specifically, the thermal sensing bulb 50 controls the flow of refrigerant through the expansion valve 48 in response to the temperature in the purge separation vessel 29.

The refrigerant/noncondensable input stage 22 comprises a refrigerant/noncondensable conduit 54 operatively coupled between the chiller condenser 14 of the chiller 12 and the purge inlet conduit 30 of the refrigerant separation stage 20 to selectively feed uncondensed refrigerant and noncondensables thereto having an isolation valve 56, an inlet filter drier 58 and a compressor 60 operatively coupled thereto.

The refrigerant output stage 24 comprises a refrigerant conduit 62 operatively coupled between the bottom portion of the interior of the purge separation vessel 29 of the refrigerant separation stage 20 and the chiller evaporator 18 of the chiller 12 to selected feed liquid refrigerant thereto having a liquid drier 64, a moisture indicating sight glass 66, an isolation valve 68 and an outlet valve 70 operatively coupled thereto.

The noncondensable output stage 26 comprises a noncondensable conduit 72 extending from the upper portion of the interior of the purge separation vessel 29 of the refrigerant separation stage 20 to the atmosphere having a check valve 74 and a disposable carbon filter 76 operatively coupled thereto. A pressure relief valve 77 is coupled to the noncondensable conduit 72 to release gases into the atmosphere when the pressure with the purge separation vessel 29 reaches a predetermined level or pressure as a safety device.

The purge control means 28 comprises a microprocessor 80 including a visual display and a key pad 83 to program the microprocessor 80 operatively coupled to a refrigerant/noncondensable flow control section, a refrigerant flow control section and a noncondensable flow control section by a plurality of conductors or control lines each indicated as 82 to selectively control the flow of refrigerant/noncondensables, refrigerant and noncondensables respectively through the refrigerant/noncondensables input stage 22, the refrigerant output stage 24 and the noncondensable output stage 26 respectively. Each control section comprises a monitoring section to monitor preselected stage operating parameters and a flow control section to selectively control the flow of fluids therethrough.

Specifically, the monitoring device of the refrigerant/noncondensable flow control section comprises a pressure transducer 84 and a temperature sensor 86 disposed to monitor or sense the pressure and temperature within the chiller condenser 14 of the chiller 12; while, the flow control section of the refrigerant/noncondensable flow control section comprises a normally closed isolation valve 88 disposed to selectively control the flow of the refrigerant and noncondensable from the chiller condenser 14 of the chiller 12 to the refrigerant separation stage 20 through the refrigerant/noncondensable conduit 54. The monitoring section of the refrigerant flow control section comprises a liquid level sensor including a liquid level sensor element 90 disposed in the lower portion of the purge separation vessel 29 of the refrigerant separation stage 20 to monitor or sense the level of liquid refrigerant in the purge separation vessel 29; while, the flow control section of the refrigerant flow control section comprises an electronic prism switch 92 coupled to a normally closed solenoid valve 94 disposed to selectively control the flow of refrigerant from the purge separation vessel 29 of the refrigerant separation stage 20 to the chiller evaporator 18 of the chiller 12 through the refrigerant conduit 62. The monitoring device of the noncondensables flow control section comprises a pressure transducer 96 and a temperature sensor 98 disposed to monitor or sense the pressure and temperature with the purge separation vessel 29 of the refrigerant stage 20; while, the flow control section of the noncondensable flow control section comprises a normally closed solenoid valve 100 disposed to selectively control the flow of noncondensables from the purge separation vessel 29 of the refrigerant separation stage 20 through the noncondensable conduit 72 to the atmosphere.

In operation, the chiller refrigerant is monitored by the pressure transducer 84 and the temperature sensor 86. The microprocessor memory has an array of pressures and temperatures relating to the specific refrigerant with the chiller 12. The pressure and temperature information received by microprocessor 80 is compared to the established pressure and temperature of the specific refrigerant in use. When the refrigerant pressure within the chiller condenser 14 of the chiller 12 is greater than the established corresponding refrigerant temperature, the refrigerant purge system 10 is actuated. Once the refrigerant purge system 10 is actuated or activated, gaseous refrigerant containing moisture and noncondensables enters refrigerant purge system 10 through the refrigerant/noncondensables conduit 54. The gas passes through the isolation valve 56 open pumpdown solenoid valve 88 into the inlet filter drier 58, or other suitable drying means, to remove moisture from such incoming hot gaseous refrigerant as a preliminary step of cleansing refrigerant of particulates and moisture prior to entering the suction side of the compressor 60. The dry, particulate-free refrigerant and noncondensable mixture is compressed by compressor 60 and feed into the purge separation vessel 29.

The interior of the purge separation vessel 29 is maintained from about twenty-five degrees F. to about thirty-five degrees F. by liquid refrigerant flowing through the evaporator coil 34. The secondary refrigeration system maintains this temperature in the purge separation vessel 29 regardless of loading conditions from the gases and noncondensables. As primary refrigerant is condensed within the purge separation vessel 29, secondary refrigerant is drawn through the vapor conduit 46 as vapor is pulled into the compressor 44 compressed and fed through compressor condenser conduit 47 into the air cooled condenser 36 where the external fan and the condenser 36 remove heat from refrigerant and condense the refrigerant. This condensed liquid refrigerant is fed through the inlet filter 42 into the thermostatically controlled expansion valve 48 where liquid is metered into the purge separation vessel 29 and regulated by the external thermal sensing bulb 50. This process continues as long as the refrigerant purge system 10 is operating. Because of this highly efficient external cooling means, all of the hot compressed gaseous fluids flowing from the purge inlet conduit 30 condense upon contact with evaporator coil 34. Condensed refrigerant collects in the bottom of purge separation vessel 29. The depth of condensed refrigerant is limited by the electronic prism switch 92. Once the condensed refrigerant, containing virtually no noncondensables, rises to a predetermined level as sensed by the liquid level sensor 90, the electronic prism switch 92 is energized. This allows the condensed liquid refrigerant to return to the chiller evaporator 18 of the chiller 12 through the refrigerant conduit 62, the liquid drier 64, the moisture indicating sight glass 66, the normally closed solenoid valve 94 that has been opened by the signal from the electronic prism switch 92 and the isolation valve 68 and finally into the chiller evaporator 18. This operation does not affect the performance of the refrigerant purge system 10. The liquid level sensor 90 has sufficient hysteresis to allow the liquid refrigerant to flow from the purge separation vessel 29 without constantly cycling the normally closed soleniod valve 94.

Since the incoming hot gaseous mixture through the purge inlet conduit 30 contains noncondensables and gaseous refrigerant, the refrigerant condenses into liquid refrigerant and separates from the other gases and noncondensables present in the purge separation vessel 29. The highly compressed gaseous vapor and noncondensables remaining within purge separation vessel 29 will separate through various partial pressures and temperature based on the specific gas laws of the refrigerant being separated from noncondensables. The temperature and pressure of this mixture is monitored by the temperature sensor 98 and the pressure transducer 96. These values are used in an internal array of various empirical and ordinary differential equations and formulas programmed into the microprocessor 80 that are used to calculate the amount of noncondensables present in the purge separation vessel 29. At a point of optimum purity or predetermined level, the noncondensables gases will be released through the noncondensable conduit 72, the check valve 74, the noncondensable conduit 72, the normally closed pumpout solenoid valve 100 and through the disposable carbon filter 76 into the atmosphere. Concurrently, the microprocessor 80 monitors and displays the amounts of each discharge of each and every pumpout cycle and alert the user when the disposable carbon filter 76 should be replaced and also when the inlet drier 58 and the outlet drier 64 should be replaced.

It will thus be seen that the objects set forth above, and those made apparent from the forgoing description, are efficiently attained and since certain changes may be made in the above construction without departing from the scope of the invention, it is intended that all matters contained in the forgoing construction or shows in the accompanying drawings shall be interpreted a illustrative and not in a limiting sense.

It is also understood that the following claims are intended to cover al the generic and specific features of the invention herein described, and all statements of the scope of the invention which, as a manner of language, might be said to fall therebetween. Now that the invention has been described.

What is claimed is:

1. A refrigerant purge system to separate noncondensables and refrigerant from a chiller and to recirculate the refrigerant to the chiller comprising a refrigerant separation stage to separate noncondensables from the refrigerant coupled to the chiller by a refrigerant/noncondensables input stage to receive refrigerant and noncondensables from the chiller when noncondensables therein reach a predetermined level, a refrigerant output stage to return condensed refrigerant to the chiller when condensed refrigerant within said refrigerant separation stage reaches a predetermined level, a noncondensable output stage to release noncondensables to the atmosphere when noncondensables within said refrigerant separation stage reach a predetermined level and a purge control means comprising a microprocessor operatively coupled to a refrigerant/noncondensable flow control section, a refrigerant flow control section and a noncondensable flow control section by a plurality of control lines to selectively control the flow of refrigerant/noncondensables, refrigerant and noncondensables respectively through said refrigerant/noncondensables input stage, said refrigerant output stage and said noncondensable output stage respectively when the noncondensables reach a predetermined level in the chiller, when the condensed refrigerant reaches a predetermined level in the chiller, when the condensed refrigerant reaches a predetermined level in said refrigerant separation stage and when the noncondensables reach a predetermined level in said refrigerant separation stage respectively, said refrigerant separation stage comprising a purge separation vessel to receive refrigerant and noncondensables from said refrigerant/noncondensables input stage through a purge inlet conduit and a secondary refrigeration system to condense gaseous refrigerant entering the interior of said purge separation vessel through said purge inlet conduit, said refrigerant/noncondensables input stage comprising a refrigerant noncondensable conduit operatively coupled between the chiller and said purge inlet conduit of said refrigerant separation stage and said refrigerant output stage comprises a refrigerant conduit operatively coupled between the interior of said purge separation vessel of said refrigerant separation stage and the chiller to return liquid refrigerant to the chiller reaches said predetermined level.

2. A refrigerant purge system comprises a refrigerant separation stage to separate noncondensables from refrigerant to feed the purged refrigerant to a chiller through a refrigerant/noncondensables input stage to receive the refrigerant and noncondensables from the chiller when the noncondensables therein reach a predetermined level and to said chiller by a refrigerant output stage to recirculate condensed refrigerant to the chiller when condensed refrigerant within said refrigerant separation stage reaches a predetermined level, a noncondensables output stage coupled to said refrigerant separation stage to release noncondensables to the atmosphere when noncondensables within said refrigerant separation stage reach a predetermined level and a purge control means operatively coupled to the chiller, said refrigerant separation stage, said refrigerant/noncondensables input stage, said refrigerant output stage and the noncondensable output stage to control operation of said refrigerant purge system.

3. The refrigerant purge system of claim 2 wherein said refrigerant separation stage comprises a purge separation vessel to receive refrigerant and noncondensables from said refrigerant/noncondensables input stage through a purge inlet conduit, said refrigerant/noncondensable input stage comprises a refrigerant/noncondensable conduit operatively coupled between the chiller and said purge inlet conduit of the refrigerant separation stage and said refrigerant output stage comprises a refrigerant conduit operatively coupled between the interior of said purge separation vessel of said refrigerant separation stage and the chiller to selected feed liquid refrigerant thereto.

4. The refrigerant purge system of claim 1 wherein said secondary refrigeration system comprises an evaporator element disposed with said purge separation vessel in heat transfer relationship relative to said purge inlet conduit coupled to a condenser by a liquid refrigerant conduit coupled to a compressor by a vapor conduit.

5. The refrigerant purge system of claim 4 wherein said secondary refrigeration system further includes a flow control comprising an expansion valve operatively disposed in said liquid refrigerant conduit and a thermal sensing bulb operatively disposed in a temperature sensing relationship relative to said vapor conduit coupled to said expansion valve by a control line to control the flow of liquid refrigerant therethrough.

6. The refrigerant purge system of claim 1 further including an isolation valve and a compressor operatively coupled to said refrigerated noncondensables conduit.

7. The refrigerant purge system of claim 1 further including an isolation valve and an outlet valve operatively coupled to said refrigerant conduit.

8. The refrigerant purge system of claim 1 wherein said noncondensable output stage comprises a noncondensable conduit extending from the interior of said purge separation vessel of said refrigerant separation stage to the atmosphere.

9. The refrigerant purge system of claim 8 further including a check valve operatively coupled to said noncondensable conduit.

10. The refrigerant purge system of claim 1 wherein each said flow control section comprises a monitoring section to monitor preselected stage operating parameters of the corresponding stage and a flow control section to selectively control the flow of fluids through the corresponding stage.

11. The refrigerant purge system of claim 10 wherein said monitoring device of said refrigerant/noncondensable flow control section comprises a pressure transducer and a temperature sensor disposed to monitor or sense the pressure and temperature within the chiller; while, said flow control section of said refrigerant/noncondensable flow control section comprises a normally closed isolation valve disposed to selectively control the flow of said refrigerant and noncondensable from the chiller to said refrigerant separation stage through said refrigerant/noncondensable conduit, said monitoring section of said refrigerant flow control section comprises a liquid level sensor including a first and second liquid level sensor element and disposed in the lower portion of said purge separation vessel of said refrigerant separation stage disposed to monitor or sense the level of liquid refrigerant in said purge separation vessel; while, said flow control section of said refrigerant flow control section comprises a normally closed solenoid valve disposed to selectively control the flow of refrigerant from said purge separation vessel of said refrigerant separation stage to the chiller through said refrigerant conduit and said monitoring device of said noncondensables flow control section comprises a pressure transducer and a temperature sensor disposed to monitor or sense the pressure and temperature within said purge separation vessel of said refrigerant stage; while, said flow control device of said noncondensable flow control section comprises a normally closed solenoid valve disposed to selectively control the flow of noncondensables from said purge separation vessel of the refrigerant separation stage through said noncondensable conduit to the atmosphere.

12. The refrigerant purge system of claim 2 wherein said refrigerant separation stage comprises a purge separation vessel to receive refrigerant and noncondensables from said refrigerant/noncondensables input stage through an purge inlet conduit and a secondary refrigeration system to condense gaseous refrigerant entering the interior of the purge separation vessel through said purge inlet conduit.

13. The refrigerant purge system of claim 12 wherein said secondary refrigeration system comprises an evaporator element disposed with said purge separation vessel in heat transfer relationship relative to said purge inlet conduit coupled to a condenser by a liquid refrigerant conduit coupled to a compressor by a vapor conduit.

14. The refrigerant purge system of claim 2 wherein a purge control means comprises a microprocessor operatively coupled to a refrigerant/noncondensable flow control section, a refrigerant flow control section and a noncondensable flow control section by a plurality of control lines to selectively control the flow of refrigerant/noncondensables, refrigerant and noncondensables respectively through said refrigerant/noncondensables input stage, the refrigerant output stage and the noncondensable output stage respectively.

15. The refrigerant purge system of claim 14 wherein each said flow control section comprises a monitoring section to monitor preselected stage operating parameters of the corresponding stage and a flow control section to selectively control the flow of fluids through the corresponding stage.

16. The refrigerant purge system of claim 15 wherein monitoring device of said refrigerant/noncondensable flow control section comprises a pressure transducer and a temperature sensor disposed to monitor or sense the pressure and temperature within the chiller; while, said flow control section of said refrigerant/noncondensable flow control section comprises a normally closed isolation valve disposed to selectively control the flow of said refrigerant and noncondensable from the chiller to said refrigerant separation stage through said refrigerant/noncondensable conduit, said monitoring section of said refrigerant flow control section comprises a liquid level sensor including a first and second liquid level sensor element and disposed in the lower portion of said purge separation vessel of said refrigerant separation stage disposed to monitor or sense the level of liquid refrigerant in said purge separation vessel; while, said flow control section of said refrigerant flow control section comprises a normally closed solenoid valve disposed to selectively control the flow of refrigerant from said purge separation vessel of said refrigerant separation stage to the chiller through said refrigerant conduit and said monitoring device of said noncondensables flow control section comprises a pressure transducer and a temperature sensor disposed to monitor or sense the pressure and temperature within said purge separation vessel of said refrigerant stage; while, said flow control device of said noncondensable flow control section comprises a normally closed solenoid valve disposed to selectively control the flow of noncondensables from said purge separation vessel of the refrigerant separation stage through said noncondensable conduit to the atmosphere.

17. The refrigerant purge system of claim 16 wherein refrigerant separation stage comprises a purge separation vessel to receive refrigerant and noncondensables from said refrigerant/noncondensables input stage through an purge inlet conduit and a secondary refrigeration system to condense gaseous refrigerant entering the interior of the purge separation vessel through said purge inlet conduit.

18. The refrigerant purge system of claim 17 wherein said secondary refrigeration system comprises an evaporator element disposed with said purge separation vessel in heat transfer relationship relative to said purge inlet conduit coupled to a condenser by a liquid refrigerant conduit coupled to a compressor by a vapor conduit.

19. The refrigerant purge system of claim 3 further comprises a secondary refrigeration system to condense gaseous refrigerant entering the interior of said purge separation vessel through said purge inlet conduit.

* * * * *